US006682362B2

(12) United States Patent
Herrmann et al.

(10) Patent No.: US 6,682,362 B2
(45) Date of Patent: Jan. 27, 2004

(54) INSULATION-DISPLACEMENT TERMINAL CONTACT, AND A CONNECTING TERMINAL

(75) Inventors: Johann Herrmann, Mllersdorf-Pfaffenberg (DE); Guenther Weissberger, Kelheim (DE)

(73) Assignee: Siemens Aktiengesellschaft, Munich (DE)

( * ) Notice: Subject to any disclaimer, the term of this patent is extended or adjusted under 35 U.S.C. 154(b) by 291 days.

(21) Appl. No.: 09/773,607

(22) Filed: Feb. 2, 2001

(65) Prior Publication Data

US 2001/0039139 A1 Nov. 8, 2001

(30) Foreign Application Priority Data

Feb. 4, 2000 (EP) ..... 00102471

(51) Int. Cl.[7] ..... H01R 4/24
(52) U.S. Cl. ..... 439/395
(58) Field of Search ..... 439/395, 398, 439/389–426, 396, 404, 468, 417

(56) References Cited

U.S. PATENT DOCUMENTS 4,136,628 A * 1/1979 McGonigal et al. ..... 113/119
4,333,700 A * 6/1982 Pugh, III ..... 439/97
5,492,485 A * 2/1996 Drewanz et al. ..... 439/404
6,027,361 A * 2/2000 Burmeister et al. ..... 439/395

FOREIGN PATENT DOCUMENTS

| | | |
|---|---|---|
| DE | 86 04 746.9 | 5/1986 |
| DE | 195 19 091 C1 | 6/1996 |
| DE | 199 21 769 A1 | 11/2000 |
| EP | 0 525 457 A2 | 2/1992 |
| EP | 0 893 845 A2 | 1/1999 |

* cited by examiner

*Primary Examiner*—P. Austin Bradley
*Assistant Examiner*—Phuongchi Nguyen
(74) *Attorney, Agent, or Firm*—Morrison & Foerster LLP

(57) ABSTRACT

An insulation-displacement terminal contact, for example for modular terminals, which has slotted, sprung contact region as a contact-making slot on a connecting bracket, which contact region is surrounded and reinforced by an outer spring clip, and which insulation-displacement terminal contact has cutting blades in the inlet region. The invention provides for the cutting blades to project toward one another behind their inlet region. A connecting terminal has an insulation-displacement terminal contact, which has a slotted, sprung contact region.

5 Claims, 2 Drawing Sheets

INSULATION-DISPLACEMENT TERMINAL CONTACT, AND A CONNECTING TERMINAL

This application claims priority to European Patent Application No. 00102471.0 filed on Feb. 4, 2000.

FIELD OF THE INVENTION

The invention relates to an insulation-displacement terminal contact, for example for modular terminals, which has a slotted, sprung contact region as a contact-making slot on a connecting bracket, which contact region is surrounded and reinforced by an outer spring clip.

BACKGROUND OF THE INVENTION

The material of the spring clip can be matched to the spring characteristics, and the contact region in the connecting bracket can be matched to its electrically conductive characteristic.

If the cutting blades form an inlet region in front of the contact-making slot, the limbs of the connecting bracket point toward one another on the contact-making slot. It has been found that, in practice, the normal manufacturing tolerances mean that it is not always possible to ensure that the limbs lie in a plane. Without increasing the production cost by reducing the tolerances, it is possible in practice for the limbs to slide past one another, with an offset. This results in the connection relationships not being ensured uniformly.

SUMMARY OF THE INVENTION

One embodiment of the invention is developing the insulation-displacement terminal contact described initially further so that constant connection characteristics are ensured with normal manufacturing tolerances.

According to the invention, the described aspect of the invention is achieved by an insulation-displacement terminal contact. In this case, the cutting blades project toward one another behind their inlet region. Since the cutting blades are produced from the spring clip, or are at least rigidly connected to the spring clip, this makes it possible to ensure that the cutting blades project toward one another in a plane. The cutting blades can also be designed to be relatively flat in this region, so that they still project toward one another reliably, even slightly offset.

It is advantageous if the cutting blades have a profile which is stepped toward the front face, on their rear face, related to their front face with the conductor inlet, such that they engage with this profile in a corresponding profile in the connecting bracket and can open the latter when they are themselves forced apart from one another and are opened by a conductor being inserted. This avoids the need for an inlet region in the contact-making slot, so that, when a previously connected conductor is removed, it cannot hook itself behind the shoulder of blades.

It is also advantageous if, the end edges of the cutting blades project in front of the spring clip with respect to the conductor inlet. In consequence, a conductor which is to be inserted cannot become hooked on the front end faces of the spring clip. In fact, it is cleanly guided to the contact-making slot in the insertion region in the cutting blades.

All of these described embodiments jointly have the advantage that the cutting blades can be manufactured from a harder material than the material of the connecting bracket in the contact-making slot. During production of an insulation-displacement terminal contact of the described type, it is advantageous if the connecting bracket engages in the region of its contact-making slot in a support on the spring clip. The connecting bracket can be fixed on the support in the spring clip using a scraping technique. In the process, the material of the spring clip is crushed down onto the connecting bracket, like a scraper. The connecting bracket is in consequence connected to the spring clip without any play, thus avoiding tolerances such as those which can occur with window-like apertures.

The insulation-displacement terminal contact can be used in a connecting terminal, possibly with further insulation-displacement terminal contacts. The connecting terminals can be in the form of a modular terminal.

BRIEF DESCRIPTION OF THE DRAWINGS

The invention will now be explained in more detail with reference to exemplary embodiments which are illustrated schematically in the drawing, in which.

DETAILED DESCRIPTION OF THE INVENTION

Figure 1:
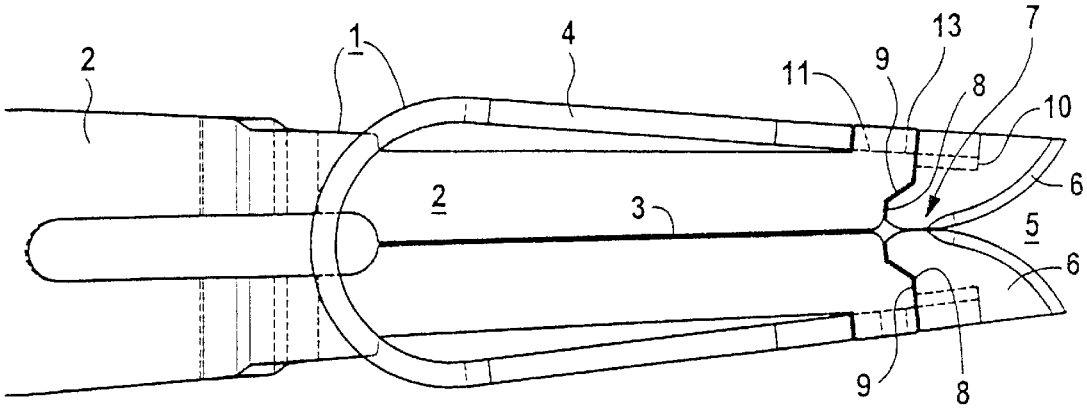
FIG. 1 shows a plan view of the contact-making slot and the cutting blades with the inlet region of an insulation-displacement terminal contact.

The insulation-displacement terminal contact 1 shown in FIG. 1 has a slotted, sprung contact region as a contact-making slot 3 on a connecting bracket 2. The contact-making slot 3 is surrounded by an outer spring clip 4, and its spring force is reinforced. The spring clip 4 is designed in an inlet region 5 to form cutting blades 6. The essential feature is that the cutting blades 6 project toward one another in a projecting region 7 behind their inlet region 5. It is advantageous to design the limbs of the connecting bracket 2 on the contact-making slot 3 to be slightly offset to the rear, so that contact in the rest state takes place only in the projecting region 7.

On their rear face, related to their front face with the conductor inlet, the cutting blades 6 have a profile which is stepped toward the front face in such a manner that they engage in a corresponding profile 9 on the connecting bracket 2, opening the latter, when the cutting blades 6 are forced apart from one another when a conductor which is to be connected is inserted.

It is advantageous if, as shown in the exemplary embodiment, the cutting blades 6 project in front of the spring clip 4, with its end edges 10, with respect to the conductor inlet. In consequence, a conductor which is to be inserted cannot become hooked on the end edges. If, for connection of a conductor, this conductor is inserted with its insulation sheathing it into the inlet region 5 of the cutting blades 6, the cutting blades cut the insulation open, and the conductor which is to be inserted drives the cutting blades apart from one another, opening them. In consequence, the profile 8 of the cutting blades together with the opposing profile 9 on the connecting bracket drives the limbs of the connecting bracket along the contact-making slot 3, opening it.

Figure 2:
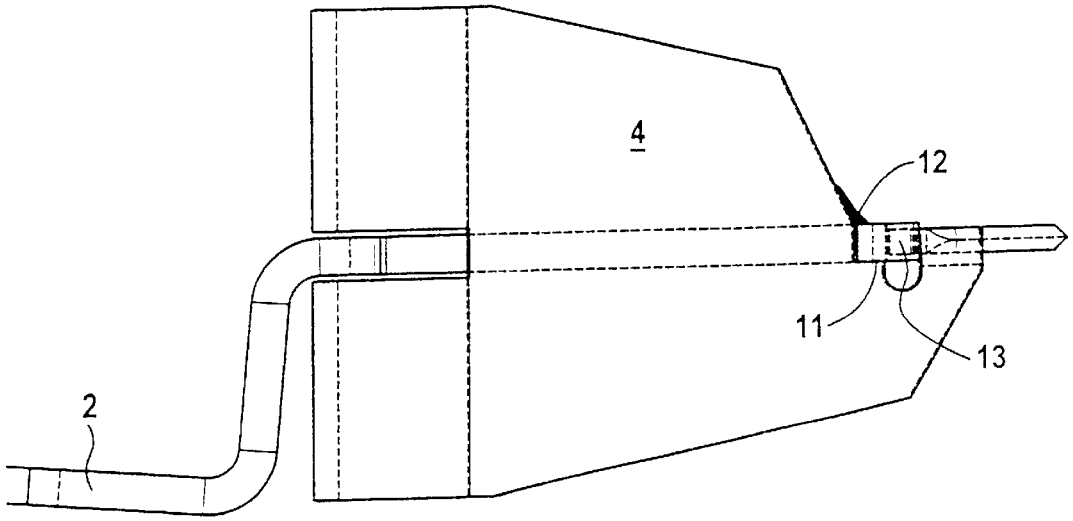
FIG. 2 shows a side view of the insulation-displacement terminal contact shown in FIG. 1.

In the region of its contact-making slot 3, the connecting bracket 2 engages in a support 11 on the spring clip 4. In this context, refer to FIGS. 2 and 3. The connecting bracket 2 is fixed on the support 11 in the spring clip 4 using a scraping technique. In the process, the material 12 of the spring clip 4 is crushed down onto a protruding tab 13 of the connecting bracket using a scraping technique, and the connecting bracket 2 is in consequence fixed to the spring clip 4.

Figure 3:
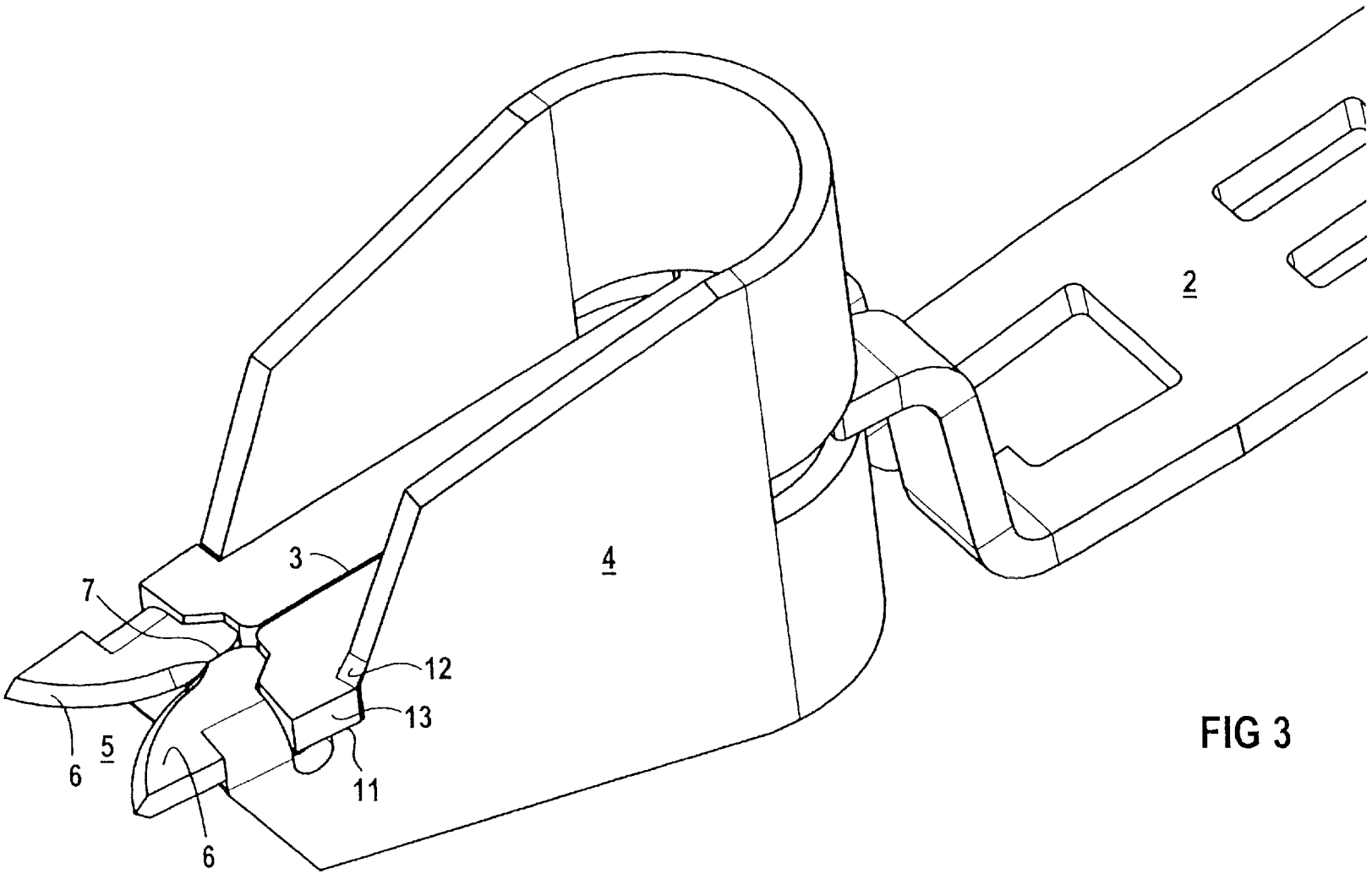
FIG. 3 shows a perspective view of an insulation-displacement terminal contact.

FIG. 3 uses a perspective illustration of an exemplary embodiment to show that the cutting blades 6 are formed from the spring clip 4 by an appropriate cutting technique, and are moved into position by bending.

A connecting terminal, if necessary with further insulation-displacement terminal contacts, can be fitted with the insulation-displacement terminal contact. Such a connecting terminal may be in the form of a modular terminal.

What is claimed is:

1. An insulation-displacement terminal contact, for modular terminals, which has a slotted, sprung contact region as a contact-making slot on a connecting bracket, which contact region is surrounded and reinforced by an outer spring clip, and which insulation-displacement terminal contact has cutting blades in the inlet region, wherein the cutting blades project toward one another in a projecting region behind their inlet region and contact one another substantially at a single point in that projection region.

2. The insulation-displacement terminal contact according to claim 1, wherein end edges of the cutting blades project in front of the spring clip with respect to the conductor inlet.

3. The insulation-displacement terminal contact, according to claim 1, wherein the cutting blades are designed to be relatively flat in their projecting region in which they project toward one another.

4. The insulation-displacement terminal contact according to claim 1 wherein the connecting bracket engages in the region of its contact-making slot in a support on the spring clip.

5. The insulation-displacement terminal contact according to claim 4, wherein the connecting bracket is fixed on the support in the spring clip using a scraping technique.

* * * * *